US007886425B2

(12) United States Patent
Liu et al.

(10) Patent No.: US 7,886,425 B2
(45) Date of Patent: Feb. 15, 2011

(54) METHOD OF MANUFACTURING A TRANSFORMER

(75) Inventors: Tzu-Yang Liu, Taoyuan Hsien (TW); Ching-Hsien Teng, Taoyuan Hsien (TW); Hsin-Wei Tsai, Taoyuan Hsien (TW); Yi-Lin Chen, Taoyuan Hsien (TW); Bou-Jun Zung, Taoyuan Hsien (TW); Chia-Hung Pai, Taoyuan Hsien (TW); Shih-Hsien Chang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 230 days.

(21) Appl. No.: 12/274,872

(22) Filed: Nov. 20, 2008

(65) Prior Publication Data

US 2009/0151153 A1 Jun. 18, 2009

Related U.S. Application Data

(63) Continuation-in-part of application No. 12/036,921, filed on Feb. 25, 2008, now Pat. No. 7,515,026.

(30) Foreign Application Priority Data

| | | |
|---|---|---|
| Dec. 17, 2007 | (TW) | 96148326 A |
| May 20, 2008 | (TW) | 97118542 A |
| Jul. 22, 2008 | (TW) | 97127830 A |

(51) Int. Cl.
*H01F 7/06* (2006.01)

(52) U.S. Cl. ..... 29/606; 29/602.1; 29/605; 336/110; 336/175; 336/178; 336/184; 336/214; 363/17; 363/48; 363/58

(58) Field of Classification Search ..... 29/602.1, 29/604–606; 336/110, 175, 178, 184, 214, 336/215, 234; 363/17, 48, 58
See application file for complete search history.

(56) References Cited

U.S. PATENT DOCUMENTS

| | | | | |
|---|---|---|---|---|
| 4,857,878 | A * | 8/1989 | Eng et al. | 336/192 |
| 5,534,839 | A * | 7/1996 | Mackin et al. | 336/192 |
| 6,611,190 | B2 * | 8/2003 | Chui et al. | 336/198 |
| 6,714,111 | B2 * | 3/2004 | Suzuki | 336/110 |
| 7,633,367 | B2 * | 12/2009 | Chen et al. | 336/198 |

* cited by examiner

*Primary Examiner*—Paul D Kim
(74) *Attorney, Agent, or Firm*—Kirton & McConkie; Evan R. Witt

(57) ABSTRACT

A method of manufacturing a transformer is disclosed. A first bobbin piece, having a first channel and a primary winding section is provided. A second bobbin comprising first and second secondary side plates, plural partition plates, a wall portion, a secondary base having a first pin arranged on a bottom surface of the secondary base, plural secondary winding sections, and a second channel is provided. A second pin is inserted into the second bobbin piece to form a wire-arranging part protruded from the second secondary side plate and an insertion part protruded from the bottom surface of the secondary base. A primary winding coil is wound on the primary winding section, and the first and second terminals of a secondary winding coil are respectively fixed on the first pin and the wire-arranging part. A magnetic core assembly is partially disposed within the first channel and the second channel.

10 Claims, 10 Drawing Sheets

33

METHOD OF MANUFACTURING A TRANSFORMER

CROSS-REFERENCE TO RELATED APPLICATION

This application is a continuation-in-part of U.S. patent application Ser. No. 12/036,921, filed on Feb. 25, 2008, now U.S. Pat. No. 7,515,026, and entitled "STRUCTURE OF TRANSFORMER". The entire disclosures of the above application are all incorporated herein by reference.

FIELD OF THE INVENTION

The present invention relates to a transformer, and more particularly to a transformer for avoiding high-voltage spark or short circuit.

BACKGROUND OF THE INVENTION

A transformer has become an essential electronic component for voltage regulation into required voltages for various kinds of electric appliances. Referring to FIG. 1, a schematic exploded view of a conventional transformer is illustrated. The transformer 1 principally comprises a magnetic core assembly 11, a bobbin 12, a primary winding coil 13 and a secondary winding coil 14. The primary winding coil 13 and the secondary winding coil 14 are overlapped with each other and wound around a winding section 121 of the bobbin 12. A tape 15 is provided for isolation and insulation. The magnetic core assembly 11 includes a first magnetic part 111 and a second magnetic part 112. The middle portion 111*a* of the first magnetic part 111 and the middle portion 112*a* of the second magnetic part 112 are embedded into the channel 122 of the bobbin 12. The primary winding coil 13 and the secondary winding coil 14 interact with the magnetic core assembly 11 to achieve the purpose of voltage regulation.

Since the leakage inductance of the transformer has an influence on the electric conversion efficiency of a power converter, it is very important to control leakage inductance. Related technologies were developed to increase coupling coefficient and reduce leakage inductance of the transformer so as to reduce power loss upon voltage regulation. In the transformer of FIG. 1, the primary winding coil 13 and the secondary winding coil 14 are overlapped with each other and wound around the bobbin 12. As a consequence, there is less magnetic flux leakage generated from the primary winding coil 13 and the secondary winding coil 14. Under this circumstance, since the coupling coefficient is increased, the leakage inductance of the transformer is reduced and the power loss upon voltage regulation is reduced, the electric conversion efficiency of a power converter is enhanced.

In the power supply system of the new-generation electric products (e.g. LCD televisions), the transformers with leakage inductance prevail. For electrical safety, the primary winding coil and the secondary winding coil of this transformer are separated by a partition element of the bobbin. Generally, the current generated from the power supply system will pass through an LC resonant circuit composed of an inductor L and a capacitor C, wherein the inductor L is inherent in the primary winding coil of the transformer. At the same time, the current with a near half-sine waveform will pass through a power MOSFET (Metal Oxide Semiconductor Field Effect Transistor) switch. When the current is zero, the power MOSFET switch is conducted. After a half-sine wave is past and the current returns zero, the switch is shut off. As known, this soft switch of the resonant circuit may reduce damage possibility of the switch, minimize noise and enhance performance.

As the size of the LCD panel is gradually increased, the length and the number of the lamps included in the LCD panel are increased and thus a higher driving voltage is required. Referring to FIG. 2, a schematic exploded view of a transformer used in the conventional LCD panels is illustrated. The transformer 2 of FIG. 2 principally comprises a magnetic core assembly 21, a first bobbin piece 22, a second bobbin piece 23, a primary winding coil 24 and a secondary winding coil 25. The first bobbin piece 22 has a first side plate 26. The second bobbin piece 23 has a second side plate 27 and a plurality of partition plates 23*a*. Several winding sections 23*b* are defined by any two adjacent partition plates 23*a*. According to voltage dividing principle, the number of winding sections 23*b* may be varied depending on the voltage magnitude. In addition, a first base 26*a* and a second base 27*a* are extended from the first side plate 26 and the second side plate 27, respectively. Several pins 28 and 29 are respectively arranged on the bottom surfaces of the first base 26*a* and the second base 27*a*.

For winding the primary winding coil 24 on the first bobbin piece 22, a first terminal of the primary winding coil 24 is firstly soldered on a pin 28*a* under the first base 26*a*. The primary winding coil 24 is then successively wound on the first bobbin piece 22 in the direction distant from the first side plate 26. Afterward, a second terminal of the primary winding coil 24 is returned to be soldered onto another pin 28*b* under the first base 26*a*. For winding the secondary winding coil 25 on the second bobbin piece 23, a first terminal of the secondary winding coil 25 is firstly soldered on a pin 29*a* under the second base 27*a*. The secondary winding coil 25 is then successively wound on the winding sections 23*b* of the second bobbin piece 23 in the direction distant from the second side plate 27. Afterward, a second terminal of the secondary winding coil 25 is returned to be soldered onto another pin 29*b* under the second base 27*a*. Moreover, due to the partition plate 23*a* of the second bobbin piece 23, the primary winding coil 24 is separated from the secondary winding coil 25, thereby maintaining an electrical safety distance and increasing leakage inductance of the transformer.

The winding structure of the transformer 2, however, still has some drawbacks. For example, since the second terminals of the primary winding coil 24 and the secondary winding coil 25 are returned to be soldered onto the pins 28*b* and 29*b* under the first base 26*a* and the second base 27*a*, respectively, portions of these second terminals are disposed under the primary winding coil 24 wound on the first bobbin piece 22 and the secondary winding coil 25 wound on the second bobbin piece 23. Even if the second terminals are covered by insulating material, the creepage distance is insufficient. Under this circumstance, the transformer 2 is readily suffered from high-voltage spark or short circuit and eventually has a breakdown.

Therefore, there is a need of providing a transformer for avoiding high-voltage spark or short circuit so as to obviate the drawbacks encountered from the prior art.

SUMMARY OF THE INVENTION

It is an object of the present invention to provide a transformer for avoiding high-voltage spark or short circuit so as to prevent damage of the transformer.

It is another object of the present invention to provide a transformer for reducing manufacturing cost.

In accordance with an aspect of the present invention, there is provided a transformer. The transformer includes a first bobbin piece, a second bobbin piece, a first pin, a second pin and a magnetic core assembly. The first bobbin piece has a first channel therein. A primary winding coil is wound on the first bobbin piece. The second bobbin piece includes a first secondary side plate, a second secondary side plate opposed to the first secondary side plate, a plurality of partition plates between the first secondary side plate and the second secondary side plate, a wall portion between every two adjacent partition plates, and a secondary base extended from an edge of the first secondary side plate. A secondary winding section is defined by every two adjacent partition plates for winding a secondary winding coil thereon. A second channel is defined within the wall portion. The first pin is arranged on a bottom surface of the secondary base. The second pin includes a wire-arranging part, an insertion part and an intermediate part between the wire-arranging part and the insertion part. The wire-arranging part is protruded from the second secondary side plate. The intermediate part is buried in the wall portion. The insertion part is protruded from the bottom surface of the secondary base. A first terminal of the secondary winding coil is fixed on the first pin and a second terminal of the secondary winding coil is fixed on the wire-arranging part of the second pin. The magnetic core assembly is embedded within the first channel of the first bobbin piece and the second channel of the second bobbin piece.

In accordance with another aspect of the present invention, there is provided a method of manufacturing a transformer. First, a first bobbin piece is provided, wherein the first bobbin piece has a first channel therein and a primary winding section. Second, a second bobbin is provided, wherein the second bobbin piece comprises a first secondary side plate, a second secondary side plate opposed to the first secondary side plate, a plurality of partition plates between the first secondary side plate and the second secondary side plate, a wall portion between every two adjacent partition plates, and a secondary base extended from an edge of the first secondary side plate and having a first pin arranged on a bottom surface of the secondary base, wherein a plurality of secondary winding sections are defined by every two adjacent partition plates, and a second channel is defined within the wall portion. Then a second pin is inserted into the second bobbin piece to penetrate through the wall portion and the second secondary side plate and form a wire-arranging part protruded from the second secondary side plate and an insertion part protruded from the bottom surface of the secondary base. Later, a primary winding coil is wound on the primary winding section, a first terminal of a secondary winding coil is fixed on the first pin and then wound on the secondary winding sections, and a second terminal of the secondary winding coil is fixed on the wire-arranging part of the second pin. Finally, a magnetic core assembly is partially disposed within the first channel of the first bobbin piece and the second channel of the second bobbin piece.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
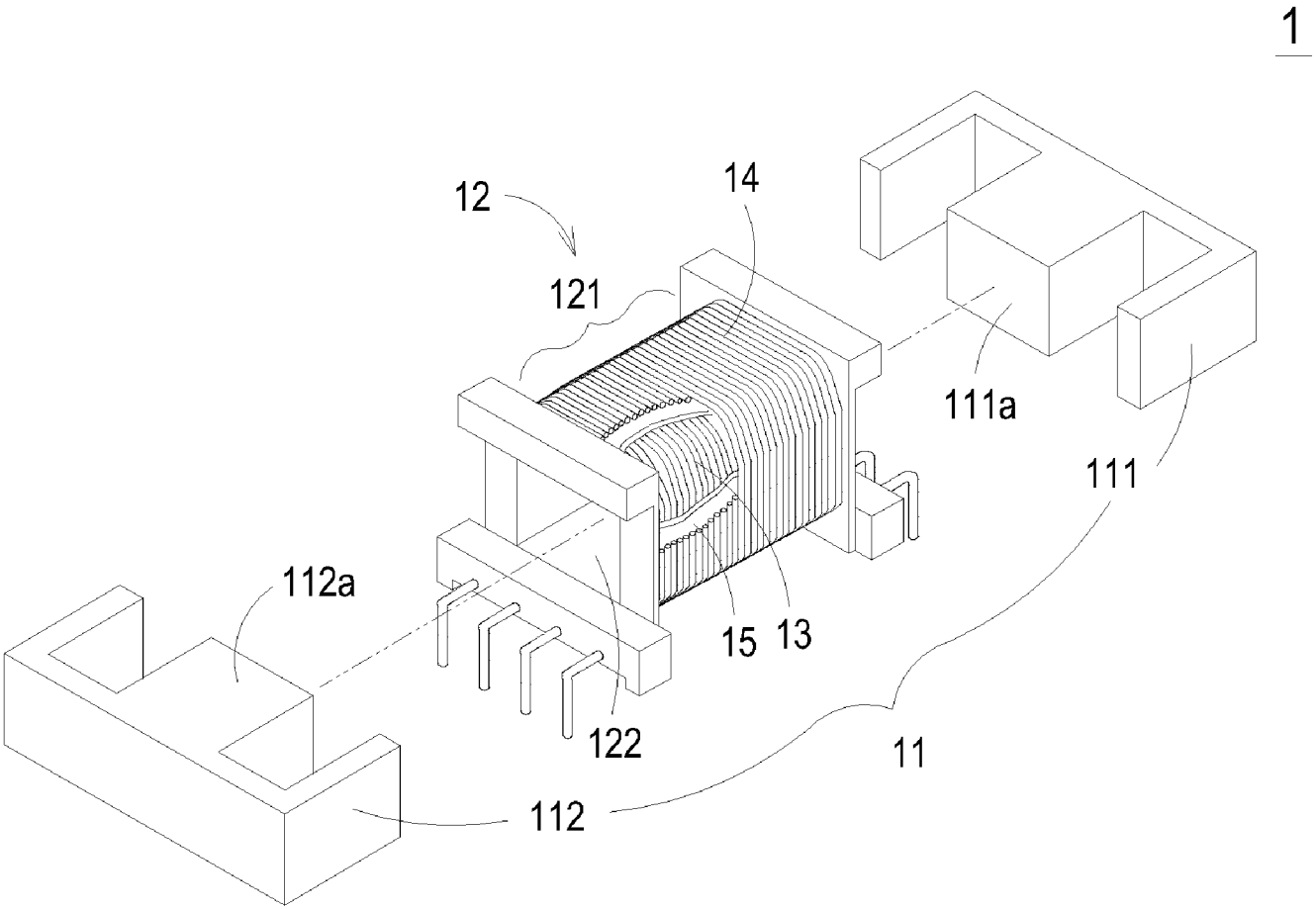
FIG. 1 PRIOR ART
FIG. 1 is a schematic exploded view of a conventional transformer.
Figure 2:
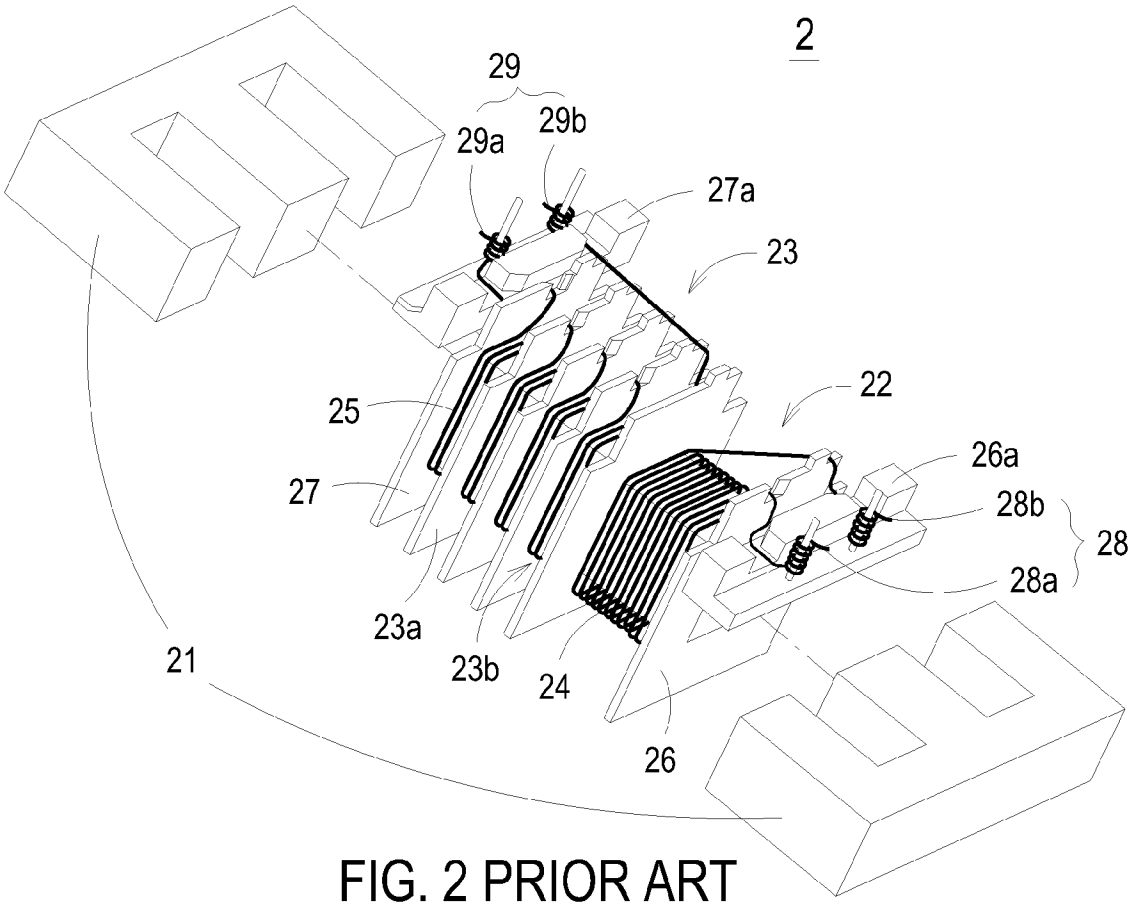
FIG. 2 PRIOR ART
FIG. 2 is a schematic exploded view illustrating a transformer used in the conventional LCD panels.
Figure 3:
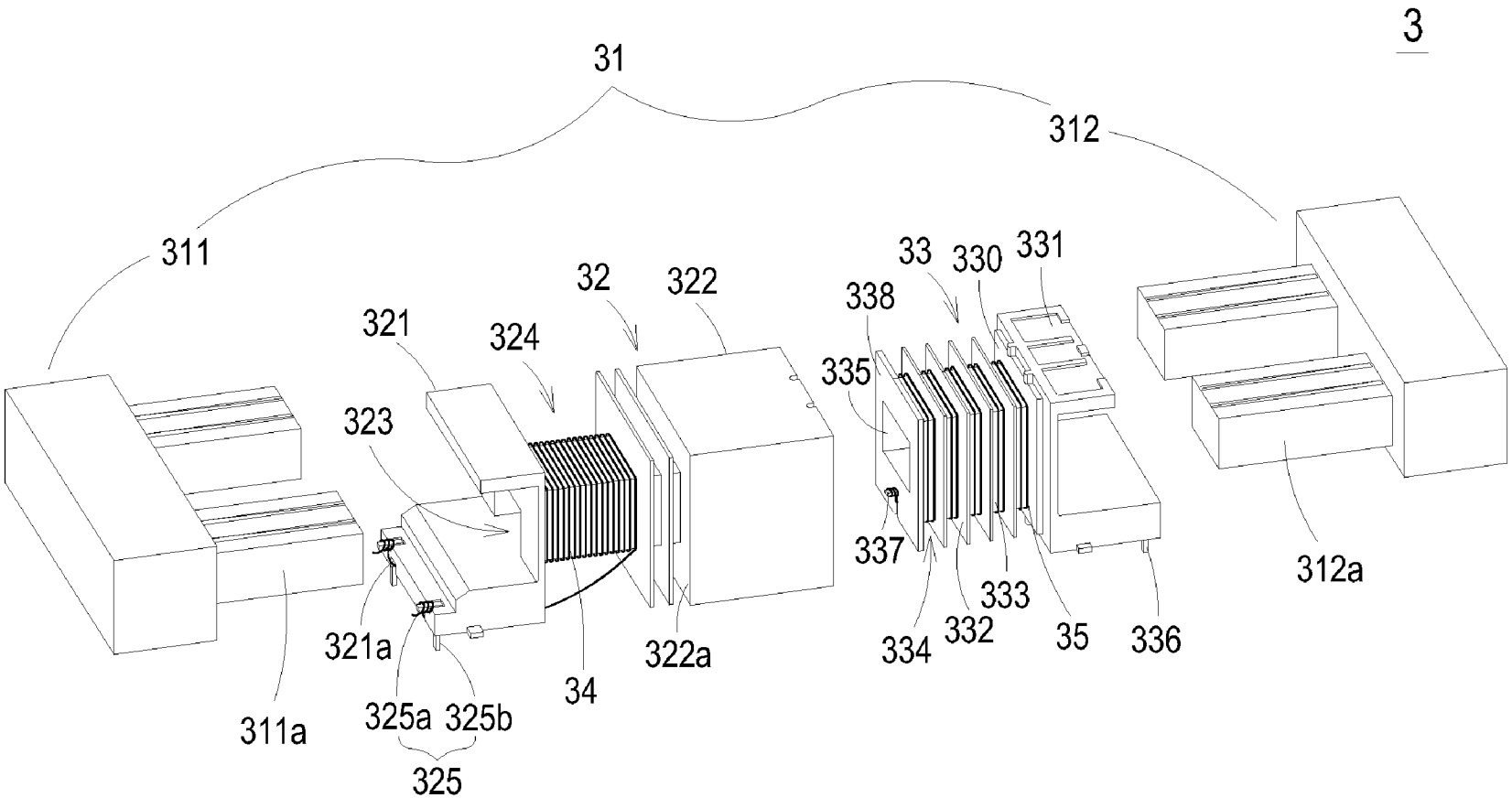
FIG. 3 is a schematic exploded view of a transformer according to a first preferred embodiment of the present invention.

Referring to FIG. 3, a schematic exploded view of a transformer according to a first preferred embodiment of the present invention is illustrated. The transformer 3 of FIG. 3 principally comprises a magnetic core assembly 31, a first bobbin piece 32, a second bobbin piece 33, a primary winding coil 34 and a secondary winding coil 35. The magnetic core assembly 31 includes a first magnetic part 311 and a second magnetic part 312. The first leg 311*a* of the first magnetic part 311 and the first leg 312*a* of the second magnetic part 312 are arranged inside the first bobbin piece 32 and the second bobbin piece 33, respectively. The primary winding coil 34 and the secondary winding coil 35 interact with the magnetic core assembly 31 to achieve the purpose of voltage regulation.

The first bobbin piece 32 includes a primary base 321, a covering element 322 and a first channel 323. A primary winding section 324 is defined between the primary base 321 and the covering element 322 such that the primary winding coil 34 can be wound on the primary winding section 324. It is preferred that the covering element 322, the primary winding section 324 and the primary base 321 are integrally formed. The covering element 322 is substantially a rectangular structure having a receptacle (not shown) therein. The first channel 323 penetrates through the primary base 321 and the primary winding section 324 and communicated with the receptacle of the covering element 322. The receptacle of the covering element 322 is provided for receiving parts of the second bobbin piece 33 and the secondary winding coil 35 wound on the second bobbin piece 33, which will be described later. Accordingly, the primary winding coil 34 and the secondary winding coil 35 are separated from each other by the covering element 322. Meanwhile, the first channel 323 of the first bobbin piece 32 and the second channel 335 of the second bobbin piece 33 are communicated with each other.

Alternatively, the first channel 323 of the first bobbin piece 32 and the second channel 335 of the second bobbin piece 33 are not communicated with each other but blocked by an insulating partition, which can be provided on the covering element 322. For example, the covering element 322 is a hollow rectangular structure formed by five side plates and have an opening in the direction away from the primary winding section 324, so that parts of the second bobbin piece 33 are received in the receptacle of the covering element 322 through the opening, wherein the side plate 322*a* of the covering element 322 which is close to the primary winding section 324 is served as an insulating partition to isolate the first leg 312*a* of the second magnetic part 312 from the primary winding coil 34 and to isolate the first leg 311*a* of the first magnetic part 311 from the secondary winding coil 35, especially to isolate the first leg 311*a* of the first magnetic part 311 from the secondary winding coil 35 wound on the wire-arranging part 337*a* (as shown in FIG. 4C) of the second pin 337 so as to avoid high-voltage spark or short circuit due to insufficient safety distance. Moreover, by controlling the thickness of the side plate 322*a*, i.e. the thickness of the insulating partition that isolates the primary side and the secondary side, the leakage inductance of the transformer can be accordingly controlled. In addition, since the primary side and the secondary side are isolated via the covering element and the insulating partition, the creepage distance is increased, and thus, the distance between the primary side and the secondary side can be reduced, so as to further reduce the integral length of the transformer.

In some embodiments, a plurality of L-shaped pin 325 are disposed on the primary base 321 of the first bobbin piece 32 for plugging onto a printed circuit board (not shown). The pins 325 are inserted into corresponding holes of the primary base 32, and each pin 325 includes a first connection part 325*a* and a second connection part 325*b*, which are substantially vertical to each other and protruded from the edges of the primary base 321, wherein the pin 325 is plugged onto the printed circuit board through the second connection part 325*b*. Preferably, the first connection part 325*a* and the second connection part 325*b* are formed integrally by bending a conductive pin made of conductive material, such as copper or aluminum, into the L-shaped pin 325, but not limited thereto. Besides, the L-shaped pin 325 can be easily assembled onto the primary base 321.

Hereinafter, an embodiment of winding the primary winding coil 34 will be illustrated as follows with reference to FIG. 3. First, a first terminal of the primary winding coil 34 is wound on and soldered on the first connection part 325*a* of one pin 325, then the primary winding coil 34 is wound through a trench 321*a* under the primary base 321 and wound around the primary winding section 324, and then wound through another trench 321*a* under the primary base 321, and finally wound on and soldered on the first connection part 325*a* of another pin 325. Since the terminals of the primary winding coil 34 are wound on the first connection parts 325*a* of the pins 325, and connected to the printed circuit board through the second connection parts 325*b*, the structural strength of the pins 325 can be enhanced and the integral height of the transformer can be reduced. Moreover, the evenness of the pins 325 would not be influenced due to that the terminals of the winding coil are not wound on the part which is connected to the printed circuit board (i.e. the second connection part 325*b*).

Figure 4A:
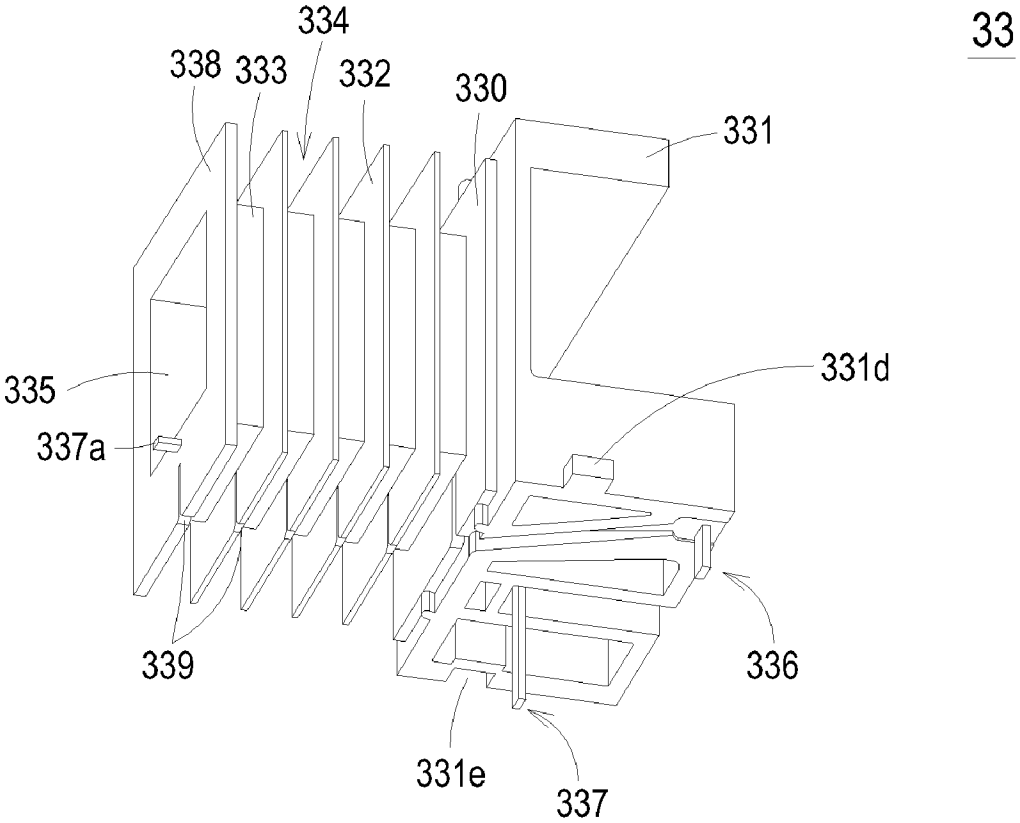
FIG. 4A is a schematic perspective view of the second bobbin piece shown in FIG. 3.

FIG. 4A is a schematic perspective view of the second bobbin piece 33 shown in FIG. 3. The second bobbin piece 33 includes a first secondary side plate 330, a second secondary side plate 338, a plurality of hollow partition plates 332, a wall portion 333 and a secondary base 331. The first secondary side plate 330, the second secondary side plate 338, the hollow partition plates 332, the wall portion 333 and the secondary base 331 have rectangular shapes. The first secondary side plate 330 and the second secondary side plate 338 are arranged on opposite sides of the second bobbin piece 33 and have apertures therein. It is preferred but not limited that the first secondary side plate 330, the second secondary side plate 338, the plurality of hollow partition plates 332, the wall portion 333 and the secondary base 331 are integrally formed.

The hollow partition plates 332 are parallel with the first secondary side plate 330 and the second secondary side plate 338. The wall portion 333 is arranged between the first secondary side plate 330 and the neighboring hollow partition plate 332, between every two hollow partition plates 332, and between the second secondary side plate 338 and the neighboring hollow partition plate 332. The wall portion 333 is also in connection with the first secondary side plate 330, the second secondary side plate 338 and the hollow partition plates 332 so as to form a second channel 335 therein. The first leg 312*a* of the second magnetic part 312 is embedded into the second channel 335. Moreover, a plurality of winding sections 334 are defined between the first secondary side plate 330, the second secondary side plate 338, the hollow partition plates 332 and the wall portion 333 for winding the secondary winding coil 35 thereon.

The secondary base 331 is extended from an edge of the first secondary side plate 330 and also has an aperture therein corresponding to that of the first secondary side plate 330. A first pin 336 and a second pin 337 are arranged on the secondary base 331 for plugging onto the printed circuit board (not shown). Furthermore, the first secondary side plate 330, the second secondary side plate 338, the hollow partition plates 332 and the secondary base 331 have corresponding notches 339.

Figure 4B:
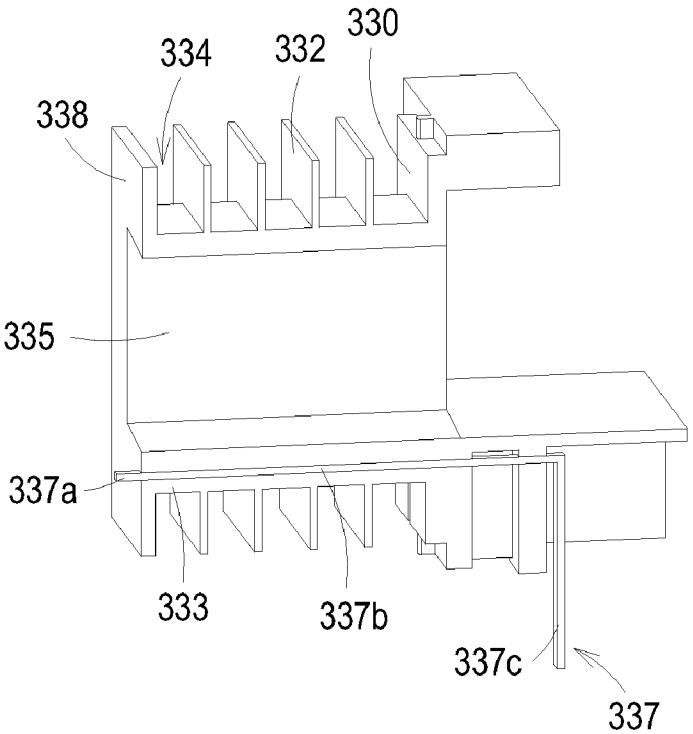
FIG. 4B is a schematic cross-sectional view of the second bobbin piece shown in FIG. 4A.
Figure 4C:
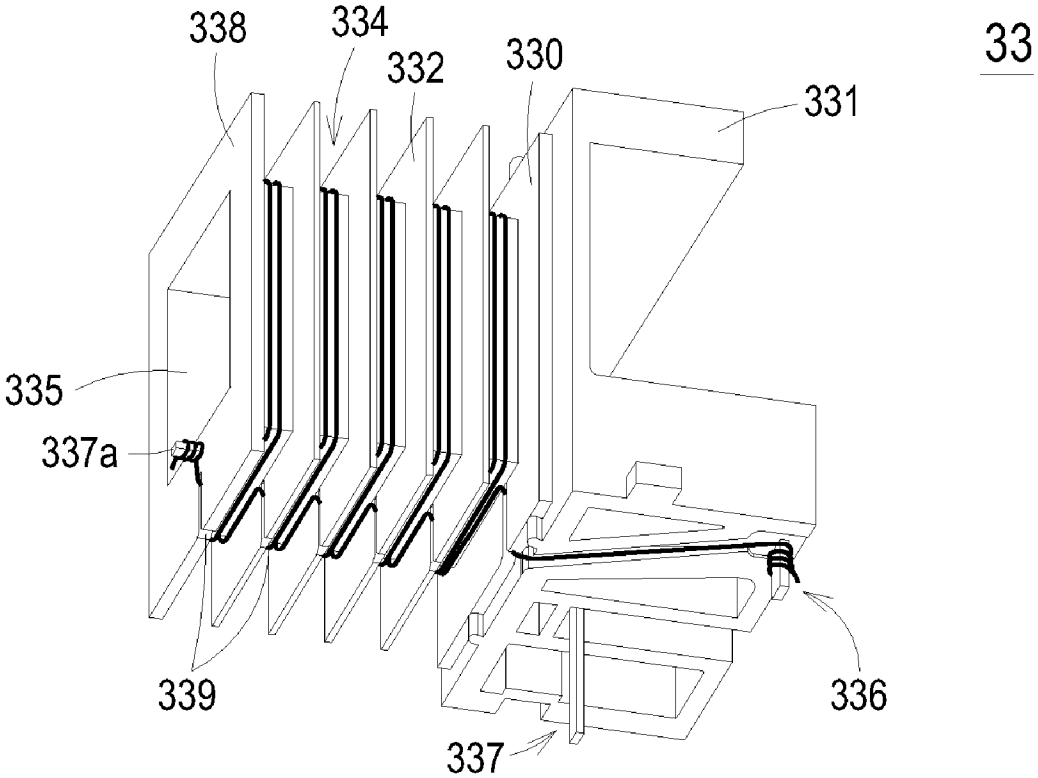
FIG. 4C is a schematic perspective view of the second bobbin piece shown in FIG. 4A having the winding coil wound thereon.

FIG. 4B is a schematic cross-sectional view of the second bobbin piece 33 shown in FIG. 4A. As shown in FIGS. 4A and 4B, the second pin 337 includes a wire-arranging part 337*a*, an intermediate part 337*b* and an insertion part 337*c*. The intermediate part 337*b* is buried in the wall portion 333 of the second bobbin piece 33 and arranged between the wire-arranging part 337*a* and the insertion part 337*c*. The intermediate part 337*b* is L-shaped. The wire-arranging part 337*a* is protruded from the second secondary side plate 338. The insertion part 337*c* is protruded from the bottom surface of the secondary base 331 to be inserted into a corresponding conductive hole of the printed circuit board, so that the transformer 3 is electrically connected to the printed circuit board. It is noted that, however, those ordinary skill in the art will readily observe that numerous modifications and alterations of the second pin 337 may be made while retaining the teachings of the invention. For example, the shape of the intermediate part 337*b* can be varied according to the profile of the second bobbin piece 33.

Hereinafter, an embodiment of winding the secondary winding coil 35 will be illustrated as follows with reference to FIG. 4C. First of all, a first terminal of the secondary winding coil 35 is wound on and soldered on the first pin 336. The secondary winding coil 35 is successively wound on the winding sections 334 from the first secondary side plate 330 to the second secondary side plate 338 through the notches 339. After a second terminal of the secondary winding coil 35 is wound on and soldered onto the wire-arranging part 337*a* of the second pin 337, the secondary winding coil 35 is fixed on the second bobbin piece 33. As a consequence, the electricity generated from the secondary winding coil 35 is transmitted from the wire-arranging part 337*a* to the printed circuit board through the intermediate part 337*b* and the insertion part 337*c*. Since the second terminal of the secondary winding coil 35 is soldered onto the wire-arranging part 337*a* of the second pin 337 without the need of returning to the first pin side, the problem of causing high-voltage spark or short circuit is avoided.

Figure 5:
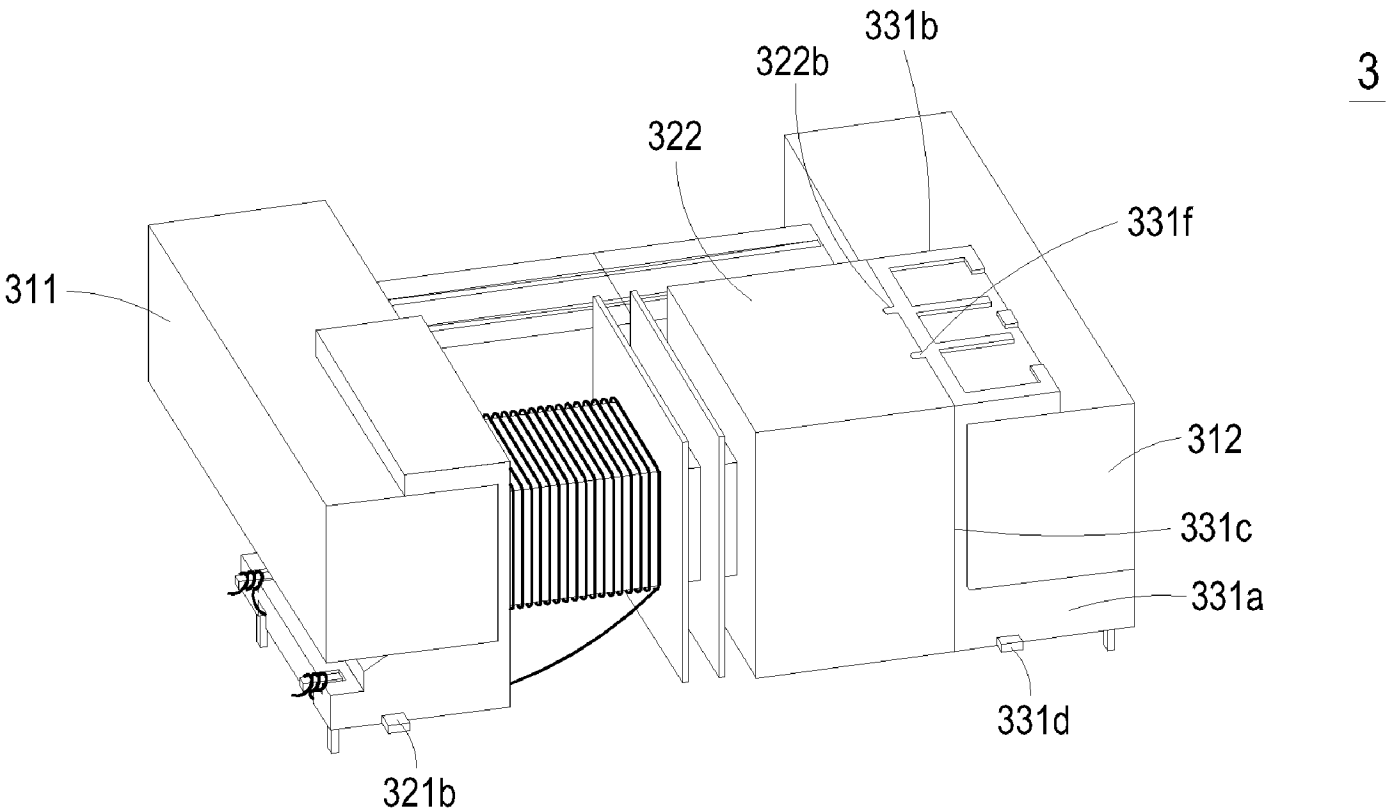
FIG. 5 is a schematic assembled view of the transformer of FIG. 3.

FIG. 5 is a schematic assembled view of the transformer of FIG. 3. As shown in FIG. 5, the secondary base 331 of the second bobbin piece 33 includes a first sidewall 331*a*, a second sidewall 331*b* and a third sidewall 331*c*. A first engaging element 331*d* (e.g. a raised block) is protruded from the first sidewall 331*a*. A second engaging element 331*e* (as shown in FIG. 4A) is disposed on the second sidewall 331*b* corresponding to the first engaging element 331*d*. The second engaging element 331*e* (e.g. an indentation) has a complementary shape to the first engaging element 331*d*. Via the first engaging element 331*d* and the second engaging element 331*e*, the transformer 3 can be combined with another transformer (not shown) so that two or more transformers can be arranged in a stack form. Optionally, the third sidewall 331*c* has a third engaging element 331*f* (e.g. a protrusion). In addition, a fourth engaging element 322*b* (e.g. a groove) is formed on the covering element 322 of the first bobbin piece 32 corresponding to the third engaging element 331*f*. When the fourth engaging element 322*b* is engaged with the third engaging element 331*f*, the first bobbin piece 32 and the second bobbin piece 33 are combined together. Furthermore, a fifth engaging element 321*b* (e.g. a raised block) and a sixth engaging element (not shown) corresponding to the fifth engaging element 321*b* are disposed on opposite sides of the primary base 321 of the first bobbin piece 32, which are similar to the first engaging element 331*d* and the second engaging element 331*e* of the secondary base 331 of the second bobbin piece 33, and are not redundantly described here.

For assembling the transformer 3, the second secondary side plate 338 of the second bobbin piece 33 and the secondary winding coil 35 wound on the second bobbin piece 33 are firstly embedded into the receptacle of the covering element 322 of the first bobbin piece 32. Accordingly, the primary winding coil 34 and the secondary winding coil 35 are separated from each other by the covering element 322. Next, the fourth engaging element 322*b* of the covering element 322 is engaged with the third engaging element 331*f* of the secondary base 331 of the second bobbin piece 33, so that the first bobbin piece 32 and the second bobbin piece 33 are combined together. Afterwards, the first leg 311*a* of the first magnetic part 311 and the first leg 312*a* of the second magnetic part 312 are embedded into the first channel 323 of the first bobbin piece 32 and the second channel 335 of the second bobbin piece 33, respectively. The assembled structure of the transformer 3 is shown in FIG. 5.

In the above embodiment, the resulting structure of the transformer 3 is substantially a rectangular solid. The appearance of the overall transformer may be varied according to the utility space and the performance requirement.

Figure 6A:
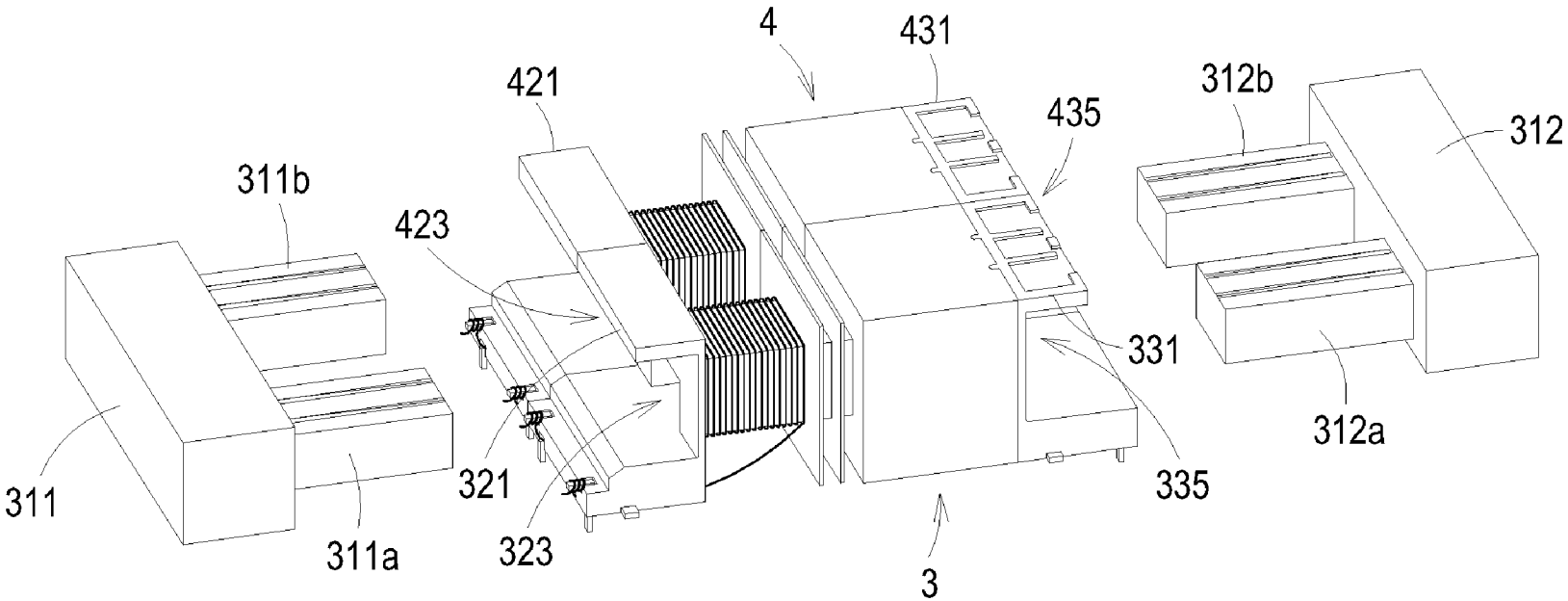
FIG. 6A is an exploded view illustrating a transformer set according to a second preferred embodiment of the present invention.
Figure 6B:
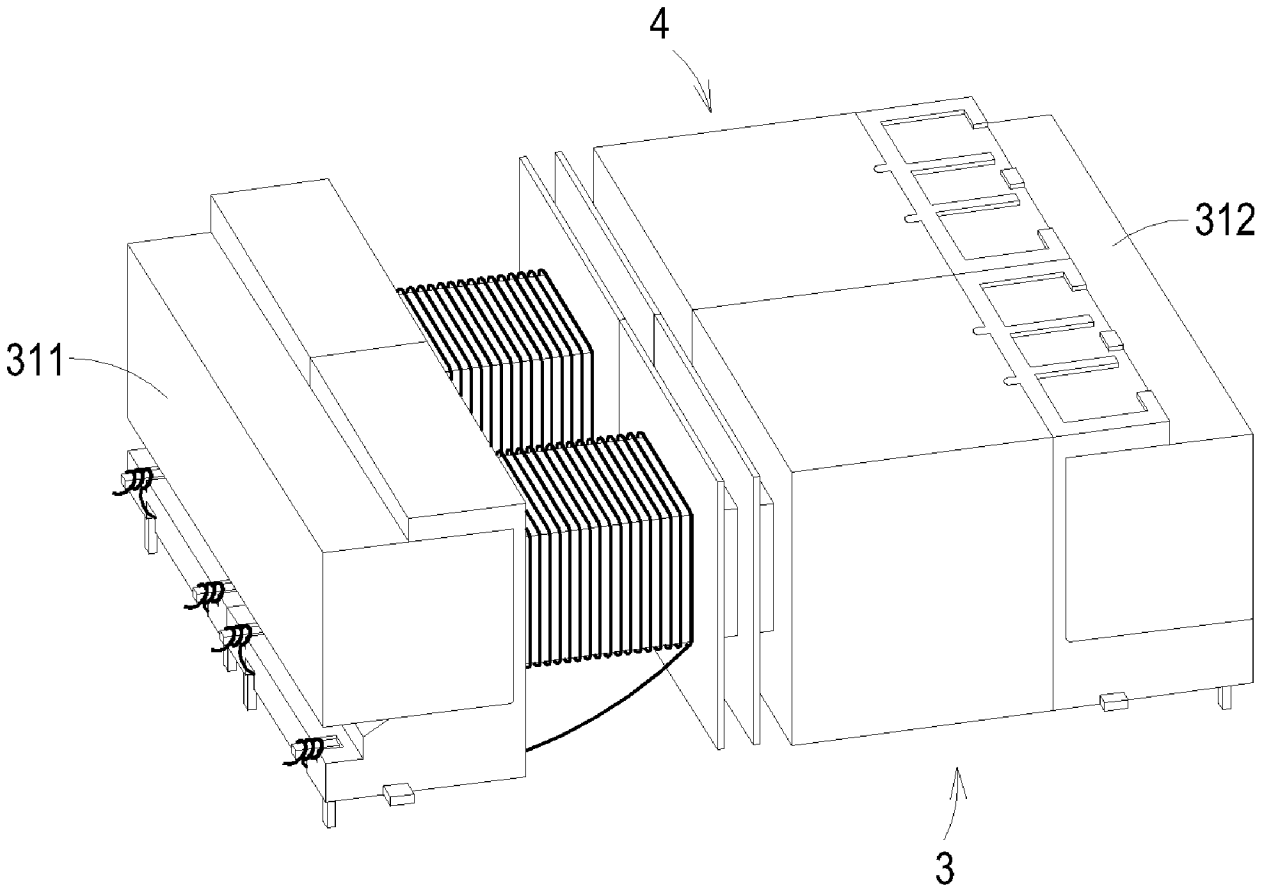
FIG. 6B is a schematic assembled view of the transformer set of FIG. 6A.

FIG. 6A is an exploded view illustrating a transformer set according to a second preferred embodiment of the present invention. In this embodiment, the transformer set is assembled by a first transformer 3 and a second transformer 4, which are arranged in parallel with each other. The first transformer 3 and the second transformer 4 are combined together via the engagement of the corresponding engaging elements on the primary base 321 and the secondary base 331 of the first transformer 3 and the primary base 421 and the secondary base 431 of the second transformer 4. The first leg 311*a* and the second leg 311*b* of the first magnetic part 311 are embedded into the first channel 323 of the first transformer 3 and the first channel 423 of the second transformer 4, respectively. Likewise, the first leg 312*a* and the second leg 312*b* of the second magnetic part 312 are embedded into the second channel 335 of the first transformer 3 and the second channel 435 of the second transformer 4, respectively. The assembled structure of the first transformer 3 and the second transformer 4 is shown in FIG. 6B.

On the other hand, the present invention also provides a method for manufacturing a transformer. First, as shown in FIG. 3, a first bobbin piece 31 which includes a primary base 321, a first channel 323, a primary winding section 324 and a covering element 322 is provided, wherein the covering element 322 has a receptacle for receiving at least parts of a second bobbin piece 33. Second, a second bobbin piece 33 which includes a first secondary side plate 330, a second secondary side plate 338, a plurality of hollow partition plates 332, a wall portion 333 and a secondary base 331 is provided, wherein a first pin 336 is arranged on the secondary base 331. The first secondary side plate 330 and the second secondary side plate 338 are arranged on opposite sides of the second bobbin piece 33, and the hollow partition plates 332 are disposed between the first secondary side plate 330 and the second secondary side plate 338. The wall portion 333 is arranged between the first secondary side plate 330 and the neighboring hollow partition plate 332, between every two hollow partition plates 332, and between the second secondary side plate 338 and the neighboring hollow partition plate 332 so as to form a second channel 335 and a plurality of secondary winding sections 334. Meanwhile, during the molding process for forming the second bobbin piece 33, the second pin 337 is arranged in the mold in advance, so that the second pin 337 is disposed on the second bobbin piece 33 as the second bobbin piece 33 is formed, and includes a wire-arranging part 337*a*, an intermediate part 337*b* and an insertion part 337*c*, wherein the intermediate part 337*b* is buried in the wall portion 333 of the second bobbin piece 33 and arranged between the wire-arranging part 337*a* and the insertion part 337*c*, the wire-arranging part 337*a* is protruded from the second secondary side plate 338, and the insertion part 337*c* is protruded from the bottom surface of the secondary base 331 for plugging onto the printed circuit board (as shown in FIG. 4B). Later, a primary winding coil 34 is wound on the primary winding section 324, and a first terminal of a secondary winding coil 35 is fixed on the first pin 336 and then wound on the secondary winding sections 334, and subsequently, the second terminal of the secondary winding coil 35 is fixed on the wire-arranging part 337*a* of the second pin 337 on the second secondary side plate 338 (as shown in FIG. 4C). After the primary winding and the secondary winding are accomplished, parts of the second bobbin piece 33 are received in the receptacle of the covering element 322 of the first bobbin piece 32. Finally, a magnetic core assembly 31 is partially embedded within the first channel 323 of the first bobbin piece 32 and the second channel 335 of the second bobbin piece 33, and the assembled structure of the transformer 3 is shown in FIG. 5.

In another embodiment, the second pin 337 can be inserted into the second bobbin piece 33 after the second bobbin piece 33 is formed. According to this embodiment, another method for manufacturing a transformer is provided. First, as shown in FIG. 3, a first bobbin piece 31 which includes a primary base 321, a first channel 323, a primary winding section 324 and a covering element 322 is provided, wherein the covering element 322 has a receptacle for receiving at least parts of a second bobbin piece 33. Second, a second bobbin piece 33 which includes a first secondary side plate 330, a second secondary side plate 338, a plurality of hollow partition plates 332, a wall portion 333 and a secondary base 331 is provided, wherein a first pin 336 is arranged on the secondary base 331. The first secondary side plate 330 and the second secondary side plate 338 are arranged on opposite sides of the second bobbin piece 33, and the hollow partition plates 332 are disposed between the first secondary side plate 330 and the second secondary side plate 338. The wall portion 333 is arranged between the first secondary side plate 330 and the neighboring hollow partition plate 332, between every two hollow partition plates 332, and between the second secondary side plate 338 and the neighboring hollow partition plate 332 so as to form a second channel 335 and a plurality of secondary winding sections 334. After the second bobbin piece 33 is formed, a second pin 337 is inserted into the second bobbin piece 33 and penetrates through the wall portion 333 and the second secondary side plate 338, so as to form a wire-arranging part 337*a*, which is protruded from the second secondary side plate 338 in the front end, and then, the rear end of the second pin 337 is bended to form an insertion part 337*c* which is protruded from the bottom surface of the secondary base 331 for plugging onto a printed circuit board. Meanwhile, an intermediate part 337*b* is defined between the wire-arranging part 337*a* and the insertion part 337*c* and buried in the wall portion 333 of the second bobbin piece 33 (as shown in FIG. 4B). Later, a primary winding coil 34 is wound on the primary winding section 324, and a first terminal of a secondary winding coil 35 is fixed on the first pin 336 and then wound on the secondary winding sections 334, and subsequently, the second terminal of the secondary winding coil 35 is fixed on the wire-arranging part 337*a* of the second pin 337 on the second secondary side plate 338 (as shown in FIG. 4C). After the primary winding and the secondary winding are accomplished, parts of the second bobbin piece 33 are received in the receptacle of the covering element 322 of the first bobbin piece 32. Finally, a magnetic core assembly 31 is partially embedded within the first channel 323 of the first bobbin piece 32 and the second channel 335 of the second bobbin piece 33, and the assembled structure of the transformer 3 is shown in FIG. 5.

Figure 7B:
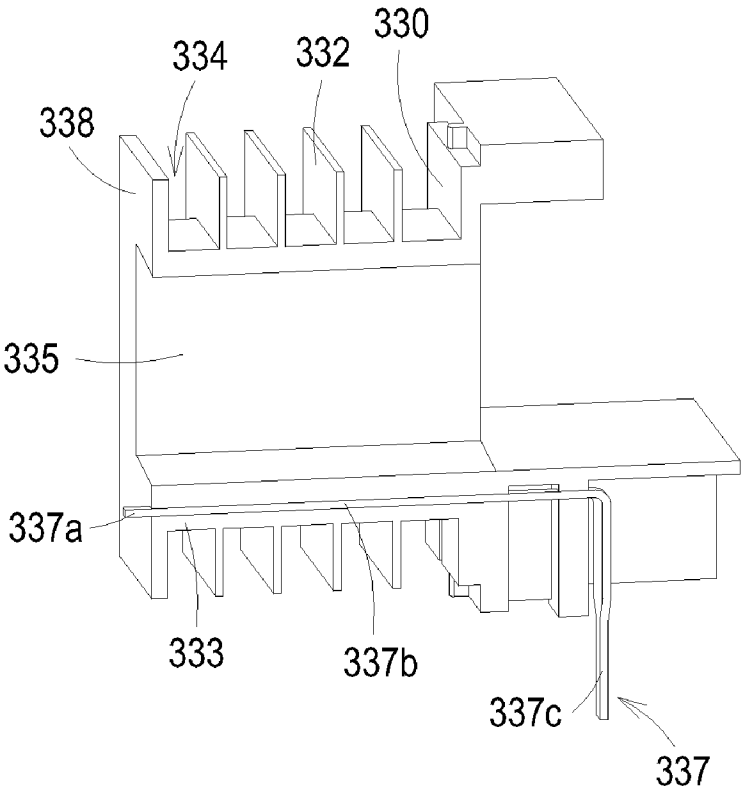
FIG. 7B is a schematic cross-sectional view of the second bobbin piece having the second pin of FIG. 7A inserted therein.
Figure 7A:
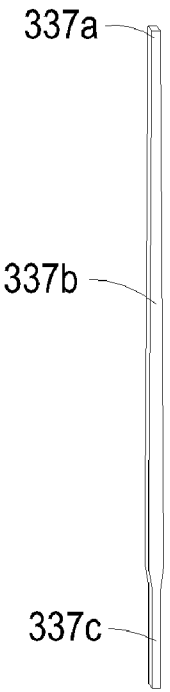
FIG. 7A is a schematic view of the second pin.

In this embodiment, since the second pin 337 does not need to be arranged in the mold in advance during the molding process of the second bobbin piece 33, the manufacturing cost in respect to the mold design and the quality control of the molding article can be greatly reduced. In addition, to facilitate the insertion and positioning of the second pin 337, the second pin 337 can be designed to have a gradually increasing width, wherein the front end (i.e. the wire-arranging part 337*a*) has a smaller width, and the width of the second pin 337 is gradually increased at the intermediate part 337*b*, and further, the width of the insertion part 337*c* is restored to the normal pin width (as shown in FIG. 7A). Therefore, when the second pin 337 is inserted into the preserved hole on the second bobbin piece 33, the gradually increasing width facilitates the positioning and fixing of the second pin 337, and then the rear end of the second pin 337 is bended to form the insertion part 337*c* (as shown in FIG. 7B). It is noted that, however, those ordinary skill in the art will readily observe that numerous modifications and alterations of the second pin 337 may be made while retaining the teachings of the invention. For example, the second pin 337 can also be designed to have an even width, and the insertion depth can be controlled by the insertion machine. Moreover, the second pin 337 can be bended to form the insertion part 337*c* in advance before the second pin 337 is inserted into the second bobbin piece 33.

From the above description, since the second terminal of the secondary winding coil is soldered onto the wire-arranging part of the second pin without returning to the first pin side, the problem of causing high-voltage spark or short circuit is avoided. As a consequence, the possibility of causing breakdown of the transformer is minimized. Moreover, the second pin can be inserted into the second bobbin piece after the second bobbin piece is formed, so as to greatly reduce the manufacturing cost of the transformer.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A method of manufacturing a transformer, comprising steps of:

providing a first bobbin piece having a first channel therein and a primary winding section;

providing a second bobbin piece comprising a first secondary side plate, a second secondary side plate opposed to said first secondary side plate, a plurality of partition plates between said first secondary side plate and said second secondary side plate, a wall portion between every two adjacent partition plates, and a secondary base extended from an edge of said first secondary side plate and having a first pin arranged on a bottom surface of said secondary base, wherein a plurality of secondary winding sections are defined by every two adjacent partition plates, and a second channel is defined within said wall portion;

inserting a second pin into said second bobbin piece to penetrate through said wall portion and said second secondary side plate and form a wire-arranging part protruded from said second secondary side plate and an insertion part protruded from said bottom surface of said secondary base;

winding a primary winding coil on said primary winding section;

fixing a first terminal of a secondary winding coil on said first pin, winding said secondary winding coil on said secondary winding sections and fixing a second terminal of said secondary winding coil on said wire-arranging part of said second pin; and partially disposing a magnetic core assembly within said first channel of said first bobbin piece and said second channel of said second bobbin piece.

2. The method of manufacturing the transformer according to claim 1 wherein said first secondary side plate, said second secondary side plate and said partition plates are parallel with each other.

3. The method of manufacturing the transformer according to claim 1 wherein each of said partition plates has a notch such that said secondary winding coil is successively wound on said secondary winding sections through said notch.

4. The method of manufacturing the transformer according to claim 1 wherein said second pin further includes an intermediate part defined between said wire-arranging part and said insertion part and buried in said wall portion of said second bobbin piece.

5. The method of manufacturing the transformer according to claim 1 wherein said second pin has a gradually increasing width, and said wire-arranging part has a smaller width.

6. The method of manufacturing the transformer according to claim 1 wherein said second pin has an even width.

7. The method of manufacturing the transformer according to claim 1 further comprising a step of bending a rear end of said second pin to form said insertion part.

8. The method of manufacturing the transformer according to claim 1 wherein said first bobbin piece further includes a covering element for partially receiving said second bobbin piece therein.

9. The method of manufacturing the transformer according to claim 8 further comprising a step of disposing parts of said second bobbin piece with said secondary winding coil wound thereon into said covering element of said first bobbin piece.

10. The method of manufacturing the transformer according to claim 1 wherein said magnetic core assembly includes a first magnetic part and a second magnetic part.

* * * * *